US008410381B2

(12) United States Patent
Yanai et al.

(10) Patent No.: US 8,410,381 B2
(45) Date of Patent: Apr. 2, 2013

(54) PUSH-ON SWITCH

(75) Inventors: Yasunori Yanai, Okayama (JP); Yoshikazu Yagi, Okayama (JP); Takashi Tomago, Okayama (JP); Akira Ishigame, Okayama (JP)

(73) Assignee: Panasonic Corporation, Osaka (JP)

( * ) Notice: Subject to any disclaimer, the term of this patent is extended or adjusted under 35 U.S.C. 154(b) by 270 days.

(21) Appl. No.: 12/876,545

(22) Filed: Sep. 7, 2010

(65) Prior Publication Data

US 2011/0089004 A1 Apr. 21, 2011

(30) Foreign Application Priority Data

Oct. 15, 2009 (JP) ..... 2009-238060
Feb. 15, 2010 (JP) ..... 2010-029770

(51) Int. Cl.
*H01H 1/06* (2006.01)

(52) U.S. Cl. ..... 200/275; 200/406; 200/512

(58) Field of Classification Search ..... 200/275, 200/284

See application file for complete search history.

(56) References Cited

U.S. PATENT DOCUMENTS

| | | | | |
|---|---|---|---|---|
| 4,794,215 | A * | 12/1988 | Sawada et al. | 200/512 |
| 7,589,607 | B2 * | 9/2009 | Rochon et al. | 335/205 |
| 8,013,262 | B2 * | 9/2011 | Honmatsu et al. | 200/5 A |
| 2003/0094359 | A1 * | 5/2003 | Yanai et al. | 200/516 |

FOREIGN PATENT DOCUMENTS

| | | | |
|---|---|---|---|
| JP | 2002-63823 | A | 2/2002 |
| JP | 2003-297175 | A | 10/2003 |

* cited by examiner

*Primary Examiner* — Renee S Luebke
*Assistant Examiner* — Lheiren Mae Caroc
(74) *Attorney, Agent, or Firm* — RatnerPrestia

(57) ABSTRACT

A high waterproof compact push-on switch includes a first contact plate, a spacer, and a second contact plate laminated in this order. The first contact plate is substantially rectangular, and made of highly conductive flat sheet metal. The spacer is flat, rectangular, made of LCP resin, and has a circular center hole at its center. The second contact plate is substantially rectangular, made of highly conductive flat sheet metal, and has a circular central opening at its center. The spacer is thermocompression-bonded to the surfaces of the first and second contact plates so as to integrate them. On the second contact plate is provided a dome-shaped movable contact, which is covered with an adhesive protective sheet.

5 Claims, 13 Drawing Sheets

PUSH-ON SWITCH

BACKGROUND OF THE INVENTION

1. Field of the Invention

The present invention relates to push-on switches mounted on operating parts of various electronic devices.

2. Background Art

As electronic devices have been smaller, lighter, thinner, and more functional in recent years, it has been strongly desired to reduce the size and thickness of push-on switches mounted on their operating parts.

A conventional push-on switch will be described as follows with reference to FIGS. 14 to 16. FIGS. 14 and 15 are a sectional view and an exploded perspective view, respectively, of the switch. FIG. 16 is a sectional view showing an operating condition of the switch. As shown in FIGS. 14 to 16, the push-on switch includes case 1, which is made of synthetic resin and has an open-top recess. The recess has an inner bottom surface in which central fixed contact 2 and two outer fixed contacts 3 symmetric with respect to central fixed contact 2 are exposed. Case 1 includes terminals 2A and 3A, which are connected to central and outer fixed contacts 2 and 3, respectively, and led out from case 1.

The push-on switch further includes movable contact 4, which is made of elastic sheet metal and is surface-treated to have high conductivity on its bottom surface. Movable contact 4 has an upwardly convex dome shape with an open bottom, and is housed in the recess of case 1 as follows. The bottom of the outer periphery of movable contact 4 is mounted on outer fixed contacts 3, and the bottom surface of the top of the dome thereof faces the top surface of central fixed contact 2 with a space therebetween.

The push-on switch further includes protective sheet 5, which is made of an insulating film and has adhesive 6 on its bottom surface. Protective sheet 5 covers the recess of case 1 and is adhesively fixed to case 1 via adhesive 6.

The conventional push-on switch thus structured operates as follows.

The user applies a compressive force to the top of the dome of movable contact 4 from above protective sheet 5. When the compressive force exceeds a predetermined force, the center of the dome of movable contact 4 is elastically inverted to a downwardly convex shape as shown in FIG. 16 with a click feel. As a result, the bottom surface of the center of movable contact 4 comes into contact with central fixed contact 2 located beneath it. This provides electrical continuity between central and outer fixed contacts 2 and 3 via movable contact 4, thereby turning on the switch between terminals 2A and corresponding terminals 3A.

When the user releases the compressive force, the center of the dome of movable contact 4 elastically returns to the upwardly convex dome shape shown in FIG. 14 with a click feel, so as to move away from central fixed contact 2. As a result, the switch between terminals 2A and corresponding terminals 3A is turned off.

Examples of a conventional technique related to the present invention are shown in Japanese Patent Unexamined Publications Nos. 2003-297175 and 2002-63823.

In the above-described conventional push-on switch, fixed contacts 2, 3 and terminals 2A, 3A are insert-molded to case 1. Therefore, when case 1 has a small thickness, its thin portion is likely to be insufficiently filled with synthetic resin during insert molding, thereby making it difficult to make the push-on switch thin and compact. Moreover, the insert-molded members are heat-shrunk, causing a small gap in the contact area between the insert-molded members and the synthetic resin. As a result, it is difficult for case 1 to have high waterproofness.

SUMMARY OF THE INVENTION

The push-on switch of the present invention includes a first contact plate, a second contact plate, a thin-film spacer, a movable contact, and a lid. The first contact plate is made of flat conductive sheet metal, and has a first terminal at an end thereof. The second contact plate, which faces the first contact plate, is made of flat conductive sheet metal, and has a second terminal at an end thereof, and a central opening at its center. The thin-film spacer having a center hole is made of insulating LCP (liquid crystal polymer) resin, and disposed between the first and second contact plates so as to be integrally bonded thereto by an anchor effect. The movable contact is mounted on the second contact plate, and has a bottom surface facing, at the center thereof, the top surface of the first contact plate with a space therebetween via the central opening of the second contact plate and the center hole of the spacer. The lid is flexible and holds the movable contact on the top surface of the second contact plate. Thus, the two laminated sheet metals replace the case used in the conventional push-on switch. Therefore, reduction in size corresponding to a thickness of the component can be realized. In addition, the spacer is thermocompression-bonded to the first and second contact plates by an anchor effect. As a result, the push-on switch of the present invention can be more compact and waterproof than the conventional push-on switch.

According to the push-on switch of the present invention, the second contact plate may include, around the central opening, a plurality of positioning holes, and the push-on switch may further include a plurality of positioning parts mounted on the second contact plate, the positioning parts being formed by softening the spacer so that the spacer is protruded upward through the positioning holes. With this structure, the positioning parts can be easily formed so as to prevent the movable contact from being displaced, for example, during installation or operation, thereby providing a good tactile feel.

According to the push-on switch of the present invention, the lid may be a heat-resistant protective sheet such as a polyimide resin film having heat-resistant adhesive like acrylic-based adhesive on the entire bottom surface thereof. With this structure, the lid can be easily mounted on the second contact plate, ensuring waterproofness between itself and the second contact plate.

According to the push-on switch of the present invention, the bottom surface of the protective sheet may not be entirely covered with adhesive, but may have a non-adhesive portion and an adhesive portion, the non-adhesive portion corresponding to the area coming into contact with the movable contact and the adhesive portion corresponding to the area coming into the second contact plate. The non-adhesive portion of the protective sheet allows the movable contact to be less affected by the protective sheet during its behavior, thereby providing a good tactile feel.

According to the push-on switch of the present invention, the second contact plate may include a tongue part extending toward the central portion of the central opening. When the movable contact is pressed and elastically inverted, the tongue part is also pressed and brought into contact with the first contact plate located beneath it, thereby turning on the switch. This makes it unnecessary for the movable contact to have electrical characteristics (high conductivity) by subjecting its bottom surface to a surface treatment such as silver plating, thereby contributing to a cost reduction.

According to the push-on switch of the present invention, the second contact plate may not have a central opening, and may have an movable part at the center thereof. The movable part has an upwardly convex dome shape and is capable of being elastically inverted. This structure forms the push-on switch only by the first and second contact plates with the spacer disposed therebetween, and seals the contact area. As a result, the push-on switch can be formed by a small number of components and be highly dust- and water-resistant.

According to the push-on switch of the present invention, the second contact plate may include a stress relaxing part around the outer periphery of the movable part, the stress relaxing part supporting behavior of the movable part. The stress relaxing part facilitates elastic deformation of the movable part on the second contact plate, allowing the movable part to have excellent behavior.

According to the push-on switch of the present invention, the second contact plate may have a plurality of slits on the same circumference around the dome-shaped movable part. Between the slits, there may be provided a plurality of joints, which are inclined to raise the movable part and connected to a flat part on the periphery of the second contact plate. The raised movable part increases the operating distance of the movable part when being elastically inverted, allowing the switch to have a long operating distance.

According to the push-on switch of the present invention, the first and second terminals may be bent to have a J shape so as to be prevented from being displaced from their mounting position during soldering.

As described hereinbefore, the push-on switch of the present invention is thin, compact, and high waterproof.

DETAILED DESCRIPTION OF THE INVENTION

Figure 1:
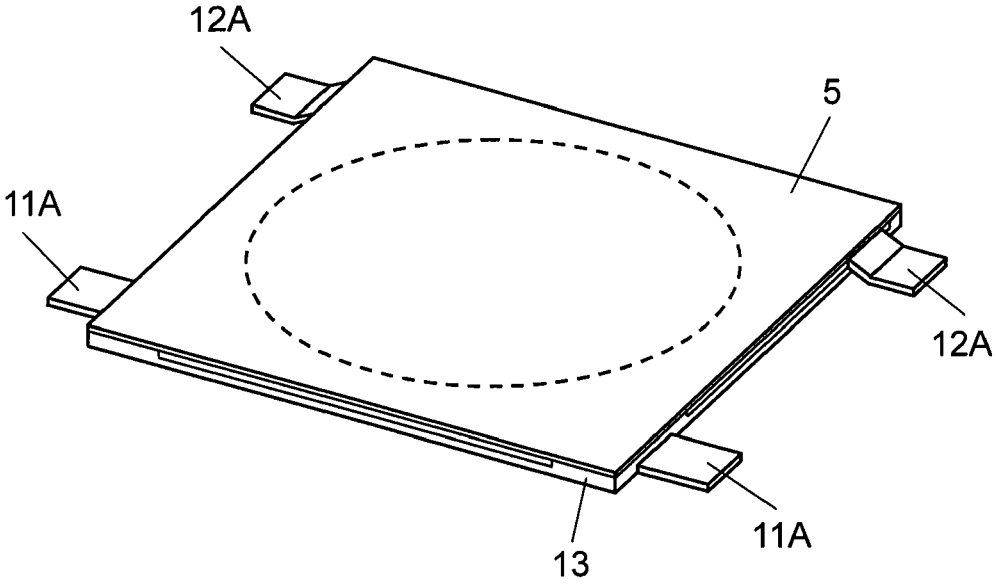
FIG. 1 is an external view of a push-on switch according to a first embodiment of the present invention.

Embodiments of the present invention will be described as follows with reference to FIGS. 1 to 13. Like components are labeled with like reference numerals with respect to the above-described conventional example, and these components are not described again in detail.

First Embodiment

Figure 2:
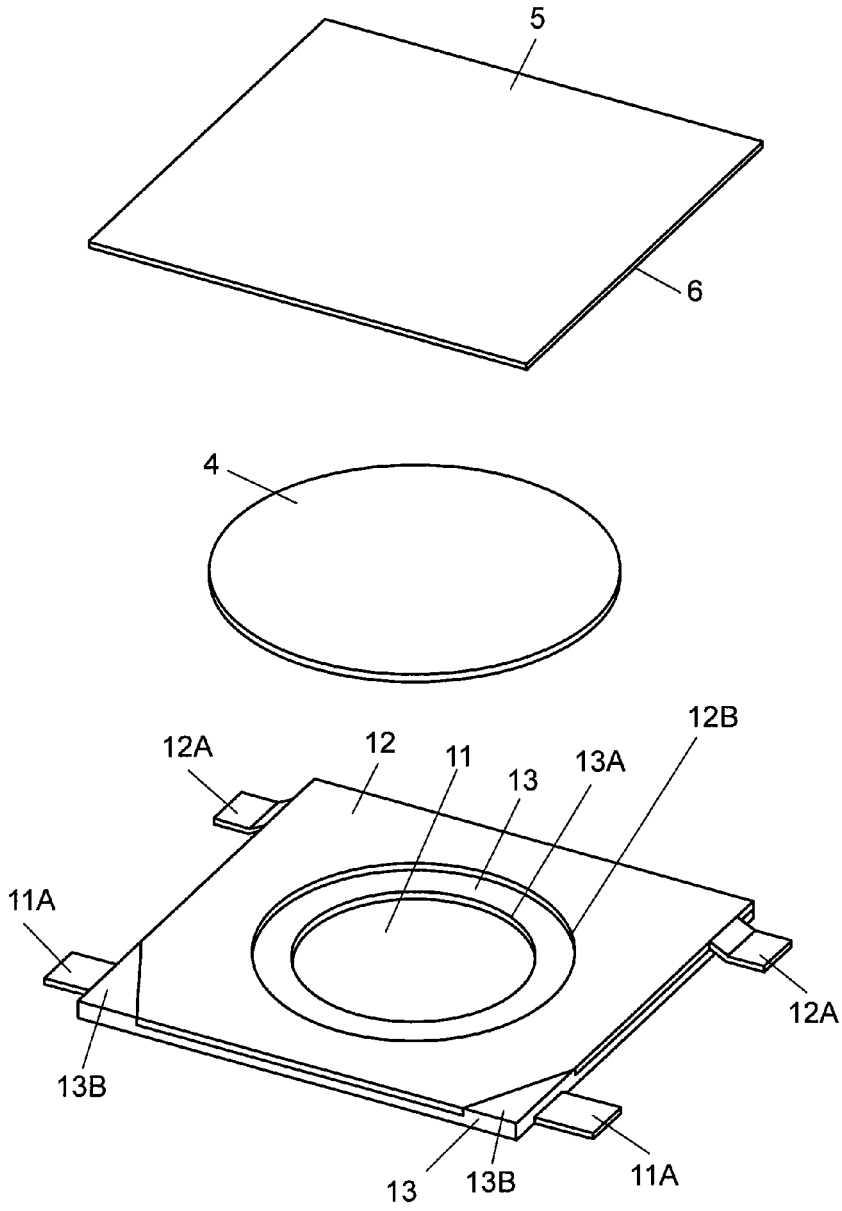
FIG. 2 is an exploded perspective view of the push-on switch according to the first embodiment of the present invention.
Figure 3:
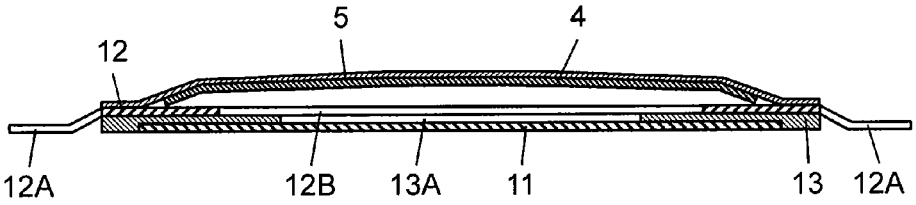
FIG. 3 is a sectional view of the push-on switch according to the first embodiment of the present invention.

FIG. 1 is an external view of a push-on switch according to a first embodiment of the present invention. FIGS. 2 and 3 are an exploded perspective view and a sectional view, respectively, of the switch.

As shown in FIGS. 1 to 3, the push-on switch includes first contact plate 11, which is substantially rectangular and made of highly conductive flat sheet metal of stainless steel plated with silver on both sides. First contact plate 11 has first terminals 11A extending outwardly from near an end of each of two opposite sides of first contact plate 11.

The switch further includes second contact plate 12, which is also substantially rectangular and made of highly conductive flat sheet metal of stainless steel plated with silver on both sides. Second contact plate 12 has circular central opening 12B at its center, and second terminals 12A extending outwardly from near the other end of each of the two opposite sides of first contact plate 11.

The switch further includes spacer 13, which is a flat rectangular thin film made of LCP (liquid crystal polymer) resin. Spacer 13 has circular center hole 13A, which is concentric with and smaller than central opening 12B of second contact plate 12. Spacer 13 is disposed between first and second contact plates 11 and 12 and bonded to their surfaces. Thus, first contact plate 11, spacer 13, and second contact plate 12 are laminated in this order and integrated as shown in FIG. 3.

These contact plates thus laminated and integrated correspond to case 1 of the conventional push-on switch. The laminated structure can be formed by applying heat and pressure from below first contact plate 11 and from above second contact plate 12 with spacer 13 disposed between. The thermocompression bonding enables LCP resin spacer 13 to be softened to provide an anchor effect, allowing the surface of spacer 13 to be bonded to the surfaces of first and second contact plates 11 and 12 without using an adhesive or any other fixing means.

In addition, second contact plate 12 is chamfered at its two corners corresponding to two first terminals 11A of first contact plate 11 in order to prevent a short-circuit between first and second terminals 11A and 12A during soldering or other operations. Similarly, first contact plate 11 is chamfered at its two corners corresponding to two second terminals 12A of second contact plate 12. The chamfered portions have corner projections 13B, which are formed by protruding the softened LCP resin of spacer 13 until it is flush with the top surface of second contact plate 12 or with the bottom surface of first contact plate 11, and then hardening the resin.

First contact plate 11 is smaller than second contact plate 12 when viewed from the above so as to secure an insulation distance between first and second contact plates 11 and 12 in their outer peripheral edges. In the same manner as forming corner projections 13B, the softened LCP resin of spacer 13 is applied to first contact plate 11 until the resin reaches the outer peripheral edge of second contact plate 12 and also until the resin is flush with the bottom surface of first contact plate 11. In the present embodiment, first contact plate 11 is made smaller than second contact plate 12 when viewed from the above. Alternatively, however, second contact plate 12 may be made smaller than first contact plate 11 when viewed from the above, and the softened LCP resin of spacer 13 may be applied to second contact plate 12 until the resin reaches the outer peripheral edge of first contact plate 11.

Movable contact 4 has an upwardly convex circular dome shape, and is made of elastic sheet metal that is surface-treated to have high conductivity on its bottom surface. Movable contact 4 is mounted on second contact plate 12 in such a manner that the bottom surface of the center of movable contact 4 faces the top surface of first contact plate 11 with a space therebetween via central opening 12B of second contact plate 12 and center hole 13A of spacer 13.

Rectangular protective sheet 5, which functions as a lid, is made of a heat-resistant insulating film such as a polyimide resin film.

Protective sheet 5 adhesively holds the top surface of movable contact 4 via heat-resistant adhesive 6 such as an acrylic-based adhesive on the entire bottom surface. Protective sheet 5 is also adhesively fixed to the top surface of second contact plate 12.

Protective sheet 5 can be easily adhesively mounted on second contact plate 12 via adhesive 6 on its bottom surface, thereby ensuring waterproofness between protective sheet 5 and second contact plate 12. Protective sheet 5 may be made of the same LCP resin film as spacer 13 and be thermocompression-bonded only to the top surface of second contact plate 12.

Figure 4:
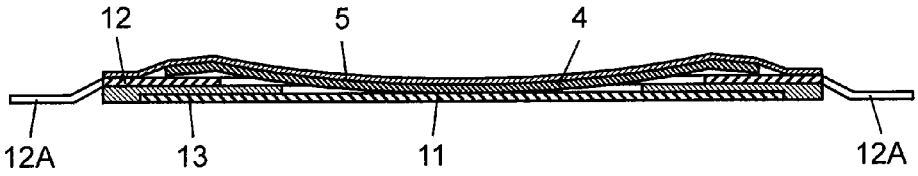
FIG. 4 is a sectional view showing an operating condition of the push-on switch according to the first embodiment of the present invention.

The operation of the push-on switch thus structured will be described as follows with reference to FIGS. 3 and 4, which are a sectional view of the switch and a sectional view of an operating condition of the switch, respectively.

When the user applies a compressive force to the center of protective sheet 5 from above, the compressive force is applied to the top of the dome of movable contact 4 located beneath it. When the compressive force exceeds a predetermined force, the center of the dome is elastically inverted to a downwardly convex shape as shown in FIG. 4 with a click feel. As a result, the bottom surface of the center of movable contact 4 comes into contact with the top surface of first contact plate 11 located beneath it. This provides electrical continuity between first and second contact plates 11 and 12 via movable contact 4, thereby turning on the switch between first terminals 11A and second terminals 12A.

When the user releases the compressive force applied to protective sheet 5, the bottom surface of the center of movable contact 4 elastically returns to the upwardly convex dome shape by its self returning force with a click feel, so as to move away from the top surface of first contact plate 11. As a result, the switch between first terminals 11A and corresponding second terminals 12A is turned off.

As described hereinbefore, according to the present embodiment, case 1 used in the conventional example is replaced by first and second contact plates 11 and 12 made of flat conductive sheet metal. Thin-film spacer 13 disposed between contact plates 11 and 12 is made of LCP resin, and if softened with heat and pressure so as to provide an anchor effect on the surfaces of contact plates 11 and 12, thereby being bonded together into a laminated structure. With this simple laminated structure, the push-on switch can be made thinner by reducing the thickness of each of first and second contact plates 11, 12 and spacer 13. Furthermore, due to the anchor effect, there is no gap between spacer 13 and each of first and second contact plates 11 and 12. As a result, the push-on switch can be compact and highly waterproof including the members corresponding to case 1 of the conventional example.

Figure 5:
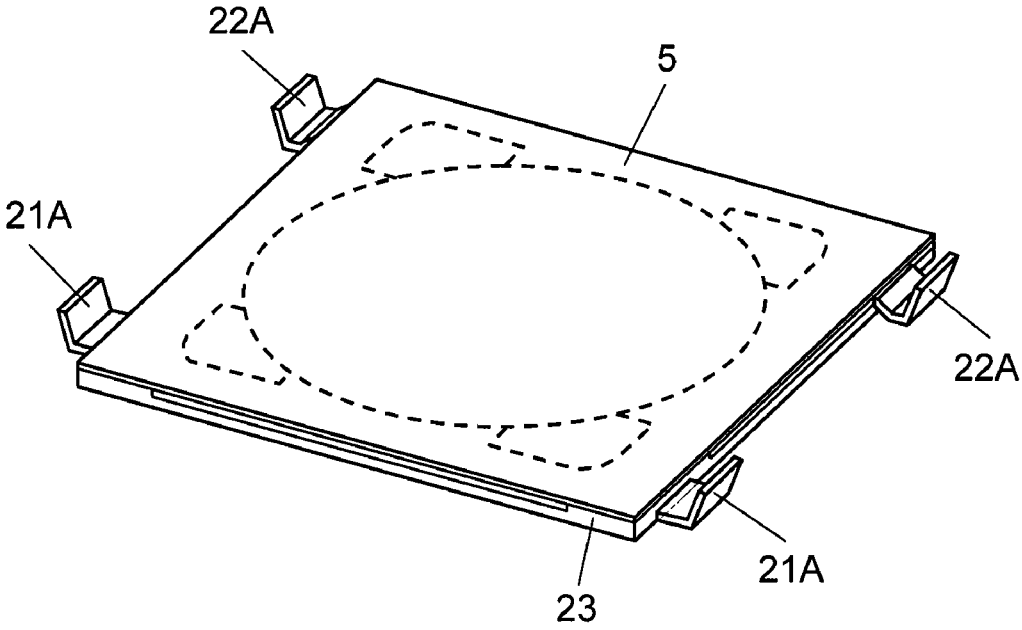
FIG. 5 is an external view of another push-on switch according to the first embodiment of the present invention.
Figure 6:
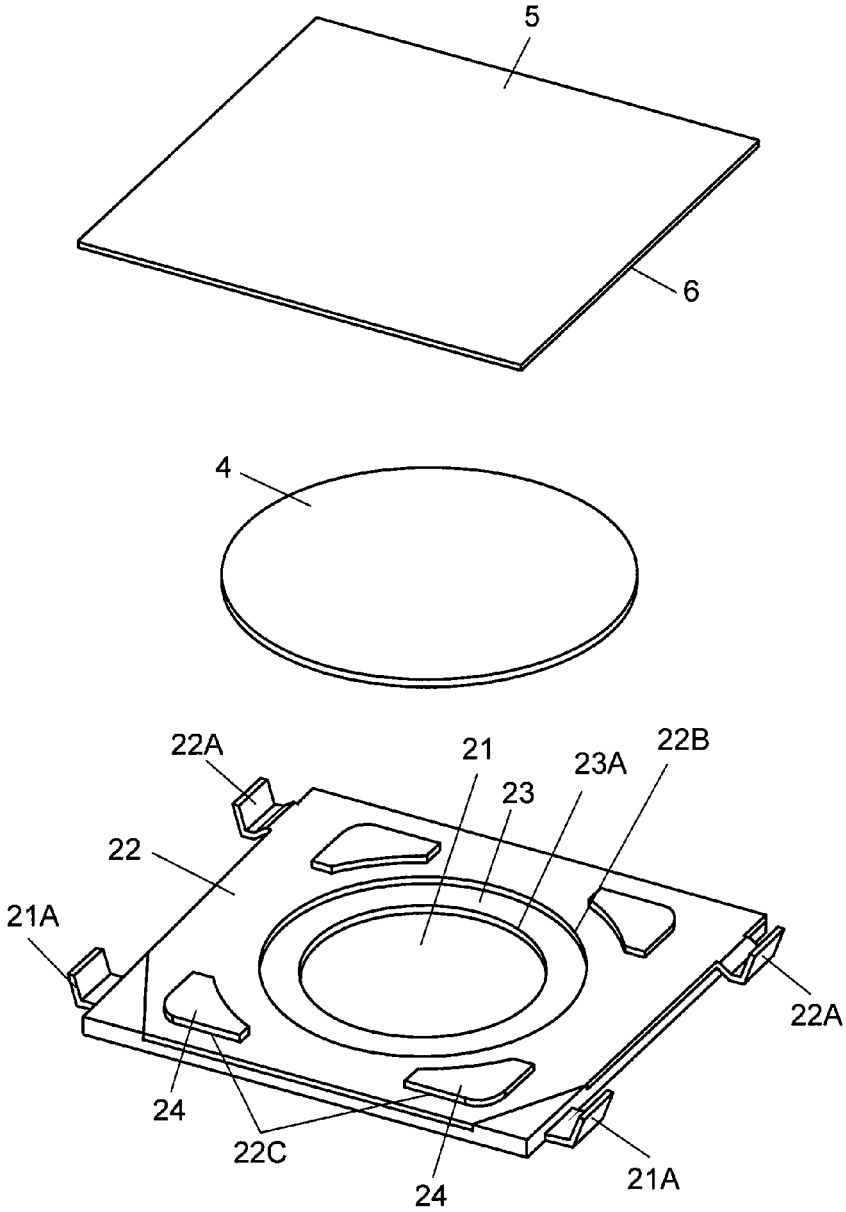
FIG. 6 is an exploded perspective view of still another push-on switch according to the first embodiment of the present invention.

FIGS. 5 and 6 are an external view and an exploded perspective view, respectively, of another push-on switch according to the present embodiment.

The push-on switch having first and second contact plates 21 and 22 shown in FIGS. 5 and 6 differs from the above-described push-on switch in the following two aspects. Firstly, substantially rectangular second contact plate 22 is provided around its circular central opening 22B with positioning holes 22C. Secondly, first and second contact plates 21 and 22 have two first terminals 21A and two second terminals 22A, respectively, which are bent obliquely upward to have a J shape (referred to as a J bent shape).

Positioning holes 22C are formed near the four corners of substantially rectangular second contact plate 22. Each positioning hole 22C is substantially triangular having two sides substantially parallel to the two sides forming the corresponding corner and one side along the circumference of central opening 22B. The one side along central opening 22B is an arc of a circle concentric with central opening 22B. The diameter of the arc is slightly larger than the outer diameter of movable contact 4. FIG. 6 is a perspective view showing first and second contact plates 21 and 22 integrated via spacer 23 in the same manner as in FIG. 2.

According to this example, spacer 23 disposed between first and second contact plates 21 and 22 is subjected to heat and pressure so as to be bonded to the surfaces of contact plates 21 and 22 by an anchor effect. The center of first contact plate 21 is exposed via central opening 22B of second contact plate 22 and center hole 23A of spacer 23.

The softened LCP resin of spacer 23 is protruded upward through positioning holes 22C of second contact plate 22, then poured into depressions for forming positioning parts 24 in an unillustrated upper mold, and is hardened. This results in the formation of four positioning parts 24, which are made of LCP resin and slightly protruded from second contact plate 22.

Positioning parts 24 correspond to positioning holes 22C at the four corners of second contact plate 22. Each positioning part 24 is substantially triangular having two sides substantially parallel to the two sides forming the corresponding corner of second contact plate 22, and one side along the circumference of central opening 22B. The one side along central opening 22B is an arc of a circle concentric with central opening 22B. The diameter of the arc is larger than the outer diameter of movable contact 4 and small enough to prevent displacement of movable contact 4. Thus, four positioning parts 24 are protrudingly formed on second contact plate 22 so as to prevent displacement of movable contact 4 fitted therewithin.

First contact plate 21, spacer 23, and second contact plate 22 laminated in this order are integrated by thermocompression bonding. Movable contact 4 is mounted within the circumference formed by four positioning parts 24 on second contact plate 22. Protective sheet 5 having adhesive 6 on its bottom surface covers movable contact 4 and is adhesively fixed to second contact plate 22.

Alternatively, similar to the push-on switch described with FIGS. 1 to 4, protective sheet 5 may be made of the same LCP resin film as spacer 23 and be thermocompression-bonded only to the top surface of second contact plate 22.

Thus, according to the present embodiment, when first and second contact plates 21, 22 and spacer 23 disposed therebetween are integrated by thermocompression bonding, positioning parts 24 for positioning movable contact 4 can be easily formed without using any additional members. As a result, movable contact 4 can be prevented from being displaced during installation or operation, thereby providing a good tactile feel.

The number of positioning holes 22C of second contact plate 22 and the number of positioning parts 24 made of the softened LCP resin of spacer 23 are not limited to four, but can be two or more as long as their internal diameters and shapes allow the positioning of movable contact 4.

The bottom surface of protective sheet 5 may have an adhesive portion (not shown) and a non-adhesive portion (not shown). The adhesive portion has adhesive 6 and is adhesively fixed to second contact plate 12 or 22. The non-adhesive portion does not have adhesive 6 and faces a part or whole of the top surface of movable contact 4. The non-adhesive portion may alternatively be formed by applying a non-adhesive material to the area of the bottom surface of protective sheet 5 that faces a part or whole of the top surface of movable contact 4. In this case, a part or whole of the top surface of movable contact 4 is less affected by protective sheet 5 while being inverted and returned elastically, thereby providing a good tactile feel.

Depending on the manufacturing process, unfinished protective sheet 5 on which movable contact 4 has been adhesively held can be adhered on second contact plate 12 or 22. In this case, of the area of unfinished protective sheet 5 that faces the top surface of movable contact 4, the central portion and the peripheral portion may be made an adhesive portion and a non-adhesive portion, respectively. Alternatively, the adhesive portion may be belt-shaped, scattered, or have any other shape to adhesively hold the top surface of movable contact 4.

In the conventional push-on switch, movable contact 4 is mounted on two outer fixed contacts 3 exposed to the inner bottom surface of the recess of case 1, so that it receives the pressure applied by the user. This causes the user to have a less tactile feel when pushing outside the center of contact 4 than when pushing the center. According to the present invention, on the other hand, the user can have a good tactile feel wherever on movable contact 4 he/she pushes because the entire bottom of its outer periphery is mounted on second contact plates 12 and 22.

Second Embodiment

A push-on switch according to a second embodiment of the present invention will be described as follows. Like components are labeled with like reference numerals with respect to the first embodiment, and these components are not described again in detail.

Figure 7:
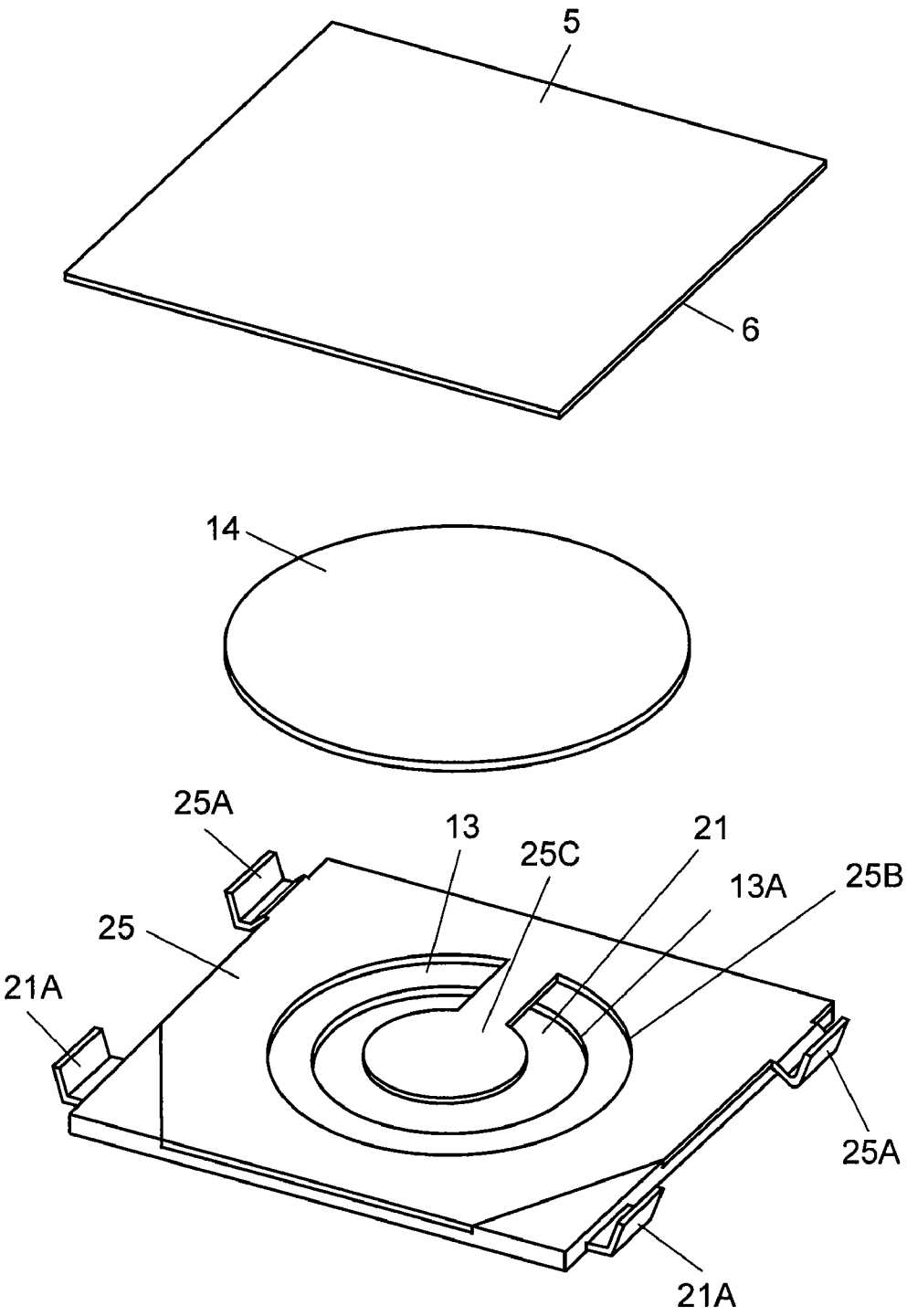
FIG. 7 is an exploded perspective view of a push-on switch according to a second embodiment of the present invention.
Figure 8:
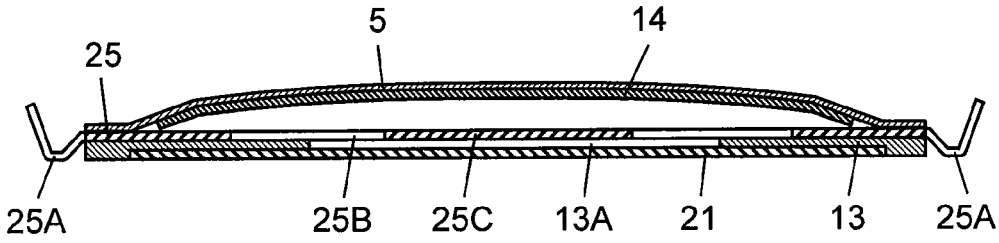
FIG. 8 is a sectional view of the push-on switch according to the second embodiment of the present invention.
Figure 9:
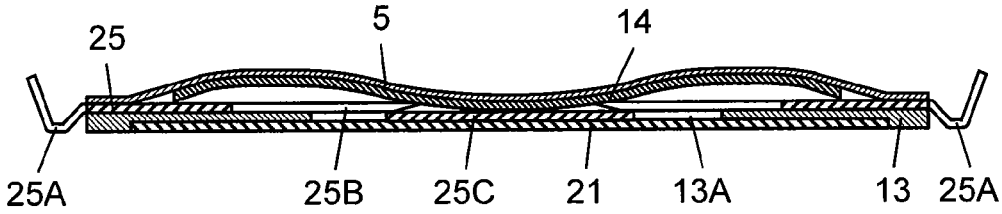
FIG. 9 is a sectional view showing an operating condition of the push-on switch according to the second embodiment of the present invention.

FIGS. 7 and 8 are an exploded perspective view and a sectional view, respectively, of the push-on switch according to the second embodiment. FIG. 9 is a sectional view showing an operating condition of the switch. As shown in FIGS. 7 to 9, first contact plate 21 is substantially rectangular, made of highly conductive flat sheet metal of stainless steel plated with silver on both sides, and has first terminals 21A. The switch further includes second contact plate 25, which is made of highly conductive sheet metal such as stainless steel, and has central opening 25B and second terminals 25A. LCP resin spacer 13 with center hole 13A is disposed between first and second contact plates 21 and 25, and integrally thermocompression-bonded to their surfaces by an anchor effect. The switch further includes movable contact 14 having an upwardly convex circular dome-shape. Movable contact 14 is mounted on second contact plate 25 so as to cover central opening 25B of second contact plate 25. Protective sheet 5 is adhesively fixed to the top surface of second contact plate 25 via adhesive 6 on its bottom surface so as to cover and hold movable contact 14. These components described so far are similar to those in the first embodiment.

The switch of the present embodiment differs from the switch of the first embodiment in the following aspects. Second contact plate 25 is plated with silver only on the bottom surface, and has flexible tongue part 25C extending from the periphery of central opening 25B toward its center. In other words, the top surface of tongue part 25C faces the bottom surface of the center of the dome of movable contact 14 with a space therebetween, and the bottom surface of tongue part 25C faces the top surface of the center of first contact plate 21 with a space therebetween. In addition, the bottom surface of movable contact 14 is not surface-treated to have high conductivity.

The push-on switch thus structured operates as follows. When the user applies a compressive force to the center of protective sheet 5 from above, the compressive force is applied to the top of the dome of movable contact 14. When the compressive force exceeds a predetermined force, the center of the dome of movable contact 14 is elastically inverted as shown in FIG. 9 with a click feel. As a result, the bottom surface of the center of the dome downwardly bends tongue part 25C of second contact plate 25 located beneath it, thereby bringing the bottom surface of tongue part 25C into contact with first contact plate 21. This provides electrical continuity between first and second contact plates 21 and 25, thereby turning on the switch between first terminals 21A and second terminals 25A.

When the user releases the compressive force applied to protective sheet 5, movable contact 14 elastically returns to the upwardly convex dome shape by its self returning force with a click feel. As a result, tongue part 25C in a bent state moves away from the top surface of first contact plate 21 by its elastic force and returns to the original position, thereby turning off the switch between first terminals 21A and corresponding second terminals 25A.

According to the present embodiment, only the bottom surface of second contact plate 25 can be surface-treated to have high conductivity. This is because the switch is turned on by pressing tongue part 25C of second contact plate 25 and bringing its bottom surface into contact with the top surface of first contact plate 21 located beneath it. In addition, the bottom surface of movable contact 14 does not need to be plated with silver or treated in other ways to have high conductivity. This is because movable contact 14 has nothing to do with electrical continuity, and therefore, is not required to have electrical characteristics (high conductivity). As a result, the cost of the components of the switch can be reduced.

Third Embodiment

A push-on switch according to a third embodiment of the present invention will be described as follows. Like components are labeled with like reference numerals with respect to the first embodiment, and these components are not described again in detail.

Figure 10:
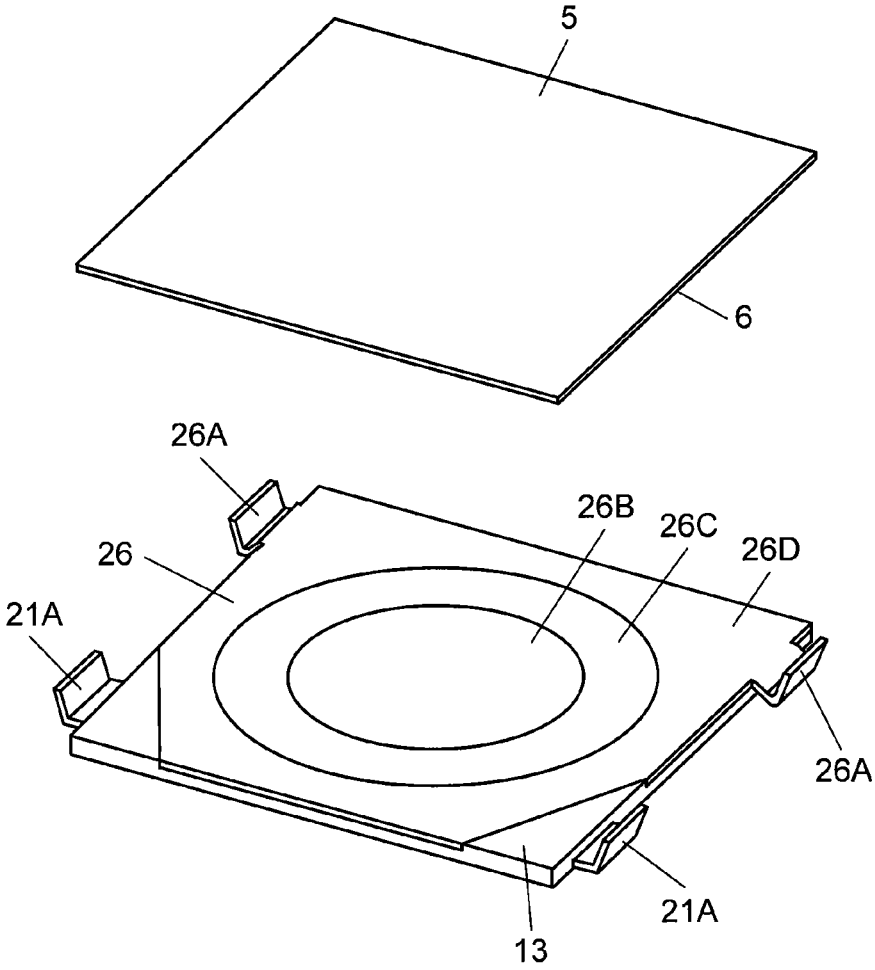
FIG. 10 is an exploded perspective view of a push-on switch according to a third embodiment of the present invention.
Figure 11:
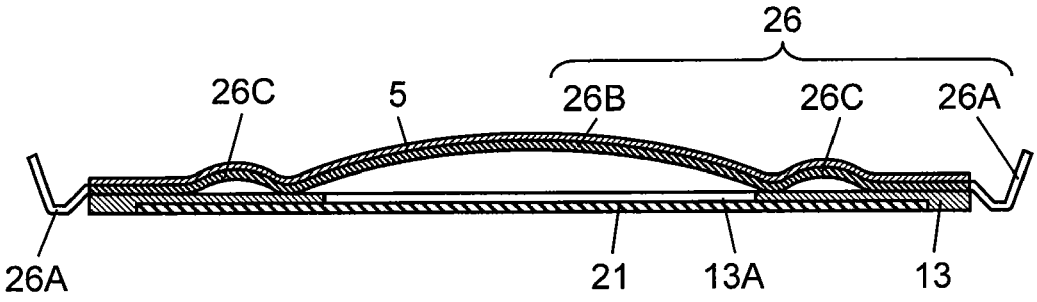
FIG. 11 is a sectional view of the push-on switch according to the third embodiment of the present invention.

FIGS. 10 and 11 are an exploded perspective view and a sectional view, respectively, of the push-on switch according to the third embodiment. As shown in FIGS. 10 and 11, first contact plate 21 is substantially rectangular, made of highly conductive flat sheet metal of stainless steel plated with silver on both sides, and has first terminals 21A. The switch further includes second contact plate 26, which is substantially rectangular, made of highly conductive sheet metal such as stainless steel, and has second terminals 26A. LCP resin spacer 13 with center hole 13A is disposed between first and second contact plates 21 and 26, and integrally thermocompression-bonded to their surfaces by an anchor effect. As a result, first contact plate 21, spacer 13, and second contact plate 26 are integrated to each other.

According to the present embodiment, second contact plate 26 is not surface-treated on its top surface, and is silver-plated on its bottom surface only. In regard to its shape, second contact plate 26 does not have a central opening like central opening 12B or 22B shown in the first embodiment, but has flat part 26D and movable part 26B in the center of flat part 26D. Movable part 26B expands in the shape of an upwardly convex circular dome, and is elastically inverted when pressed. Second contact plate 26 further has stress relaxing part 26C around the outer periphery of movable part 26B. Stress relaxing part 26C is annular and expands in the shape of an upward convex from the outer periphery of movable part 26B. The expansion is about half as high as the expansion of movable part 26B.

As described above, second contact plate 26 does not have a central opening like central opening 12B or 22B shown in the first embodiment, but has movable part 26B at its center and annular stress relaxing part 26C around the outer periphery of movable part 26B. Second contact plate 26, movable part 26B, and stress relaxing part 26C are formed integrally from a substantially rectangular elastic sheet metal.

As shown in FIGS. 10 and 11, the top surface of second contact plate 26 has protective sheet 5 of insulating film adhesively fixed thereon in the same manner as in the first and second embodiments. The purpose of this is to prevent static electricity from flowing from the user's fingers or other body parts to second contact plate 26 during the operation of the switch.

The push-on switch of the present embodiment operates as follows. The user applies a compressive force to the top of the dome of movable part 26B of second contact plate 26 from above protective sheet 5. When the compressive force exceeds a predetermined force, the center of the dome of movable part 26B is elastically inverted to a downwardly convex shape with a click feel. Then, the bottom surface of the top of the dome comes into contact with the top surface of the center of first contact plate 21 located beneath it, thereby turning on the switch. When the user release the compressive force, the dome elastically returns from the downwardly convex shape to the upwardly convex shape with a click feel, so that the center of movable part 26B moves away from first contact plate 21, thereby turning off the switch.

As described above, according to the present embodiment, movable part 26B, which is upwardly expanded in the shape of a circular dome and can be inverted and returned elastically, is formed integrally with flat second contact plate 26. This allows sealing of the contact area therebetween, and reduces the number of components. As a result, the push-on switch can be low cost and highly dust- and water-resistant.

As shown in FIGS. 10 and 11, annular stress relaxing part 26C is formed around the outer periphery of movable part 26B of second contact plate 26. This structure allows stress relaxing part 26C to be bent under the stress of movable part 26B while movable part 26B is being inverted or returned elastically. Stress relaxing part 26C facilitates elastic deformation of movable part 26B, allowing movable part 26B to have excellent behavior.

When protective sheet 5 is not used, it is possible to provide a highly dust- and water-resistant push-on switch composed of a fewer number of components. When protective sheet 5 is used, on the other hand, it is possible to provide a push-on switch suitable to be used in environments requiring countermeasures against static electricity during operation.

Fourth Embodiment

A push-on switch according to a fourth embodiment of the present invention will be described as follows. Like components are labeled with like reference numerals with respect to the third embodiment, and these components are not described again in detail.

Figure 12:
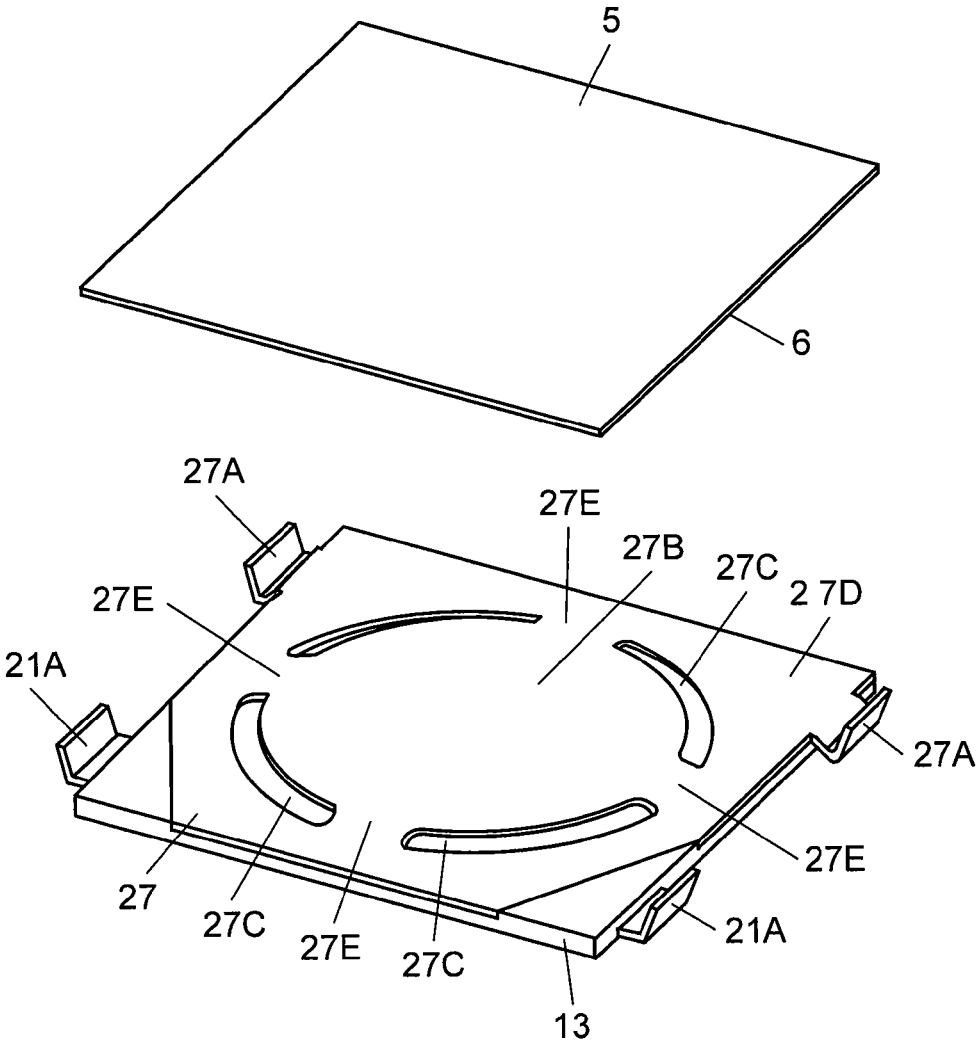
FIG. 12 is an exploded perspective view of a push-on switch according to a fourth embodiment of the present invention.
Figure 13:
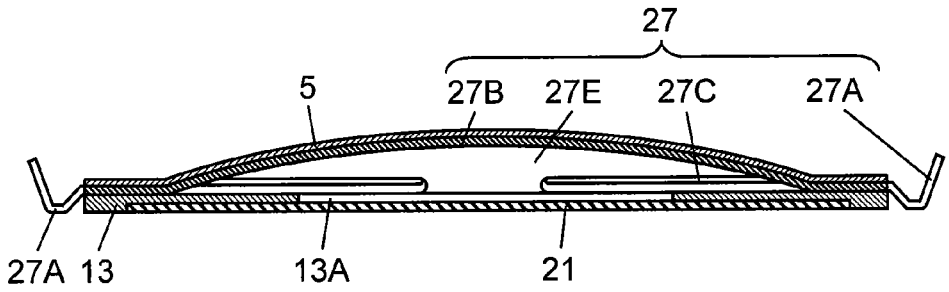
FIG. 13 is a sectional view of the push-on switch according to the fourth embodiment of the present invention.
Figure 14:
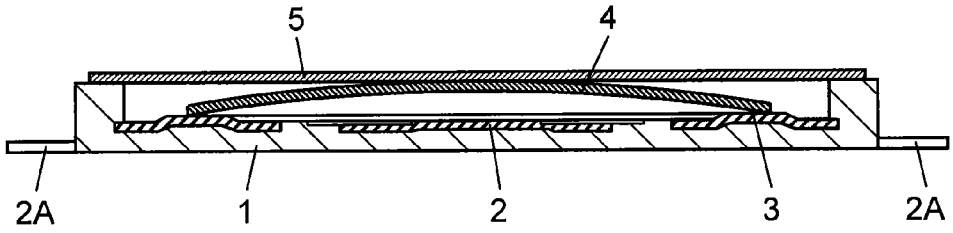
FIG. 14 PRIOR ART
FIG. 14 is a sectional view of a conventional push-on switch.
Figure 15:
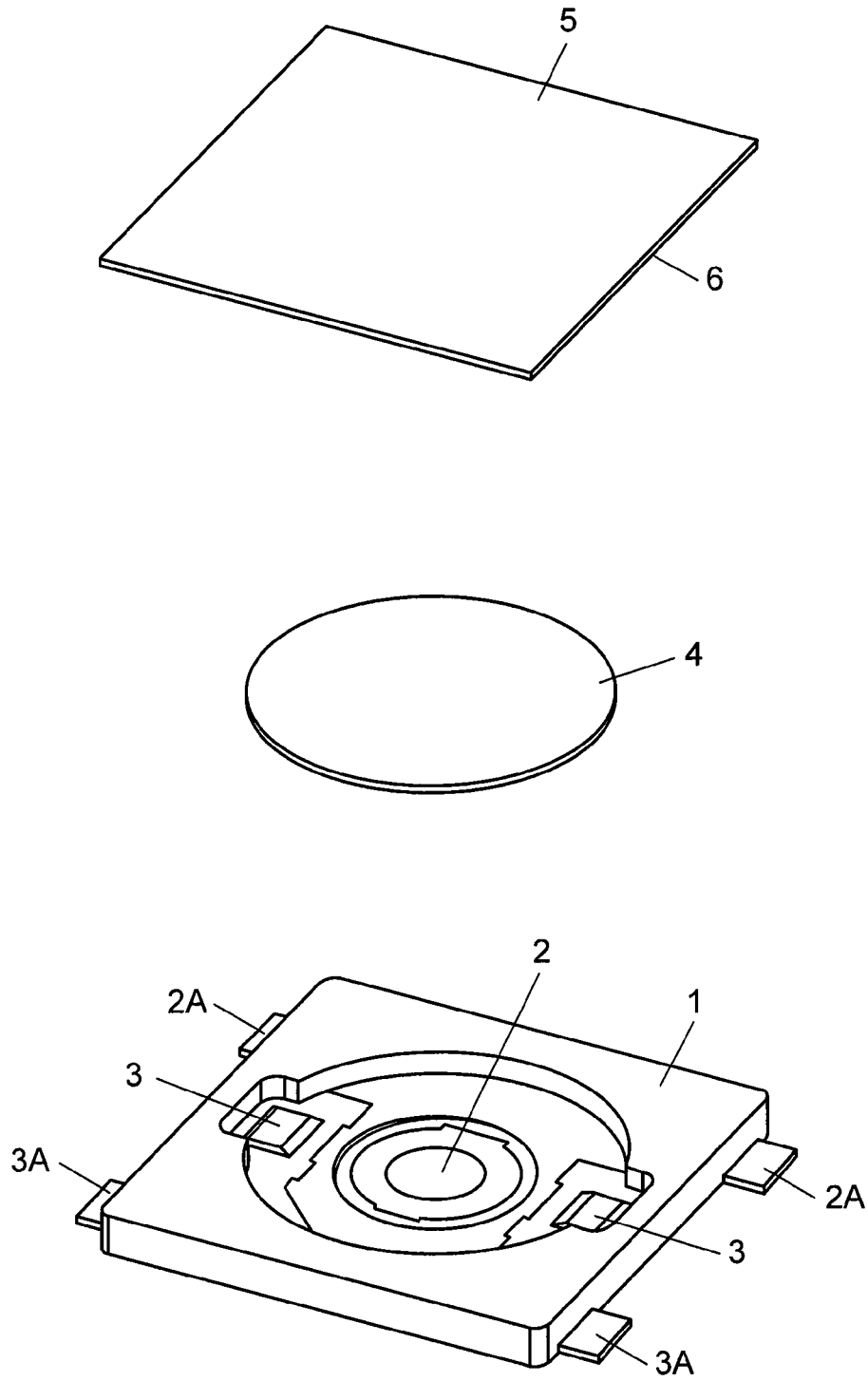
FIG. 15 PRIOR ART
FIG. 15 is an exploded perspective view of the conventional push-on switch.
Figure 16:
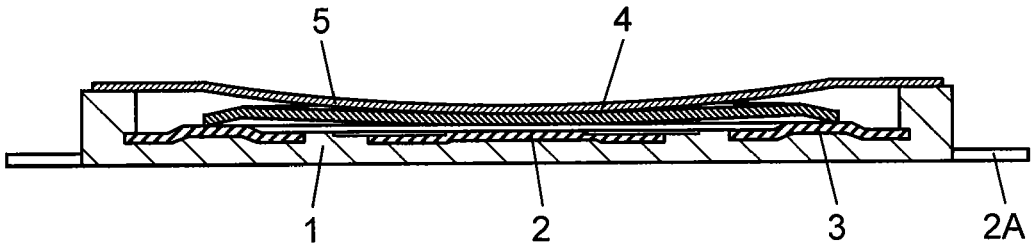
FIG. 16 PRIOR ART
FIG. 16 is a sectional view showing an operating condition of the conventional push-on switch.

FIGS. 12 and 13 are an exploded perspective view and a sectional view, respectively, of the push-on switch according to the fourth embodiment. As shown in FIGS. 13 and 14, first contact plate 21 is flat, plated with silver on both sides, and has first terminals 21A. The switch further includes second contact plate 27, which is substantially rectangular, plated with silver only on the bottom surface, and has second terminals 27A. Second contact plate 27 has, at its center, movable part 27B, which expands in the shape of an upwardly convex circular dome.

LCP resin spacer 13 with center hole 13A is disposed between first and second contact plates 21 and 27, and integrally thermocompression-bonded to their surfaces by an anchor effect. Protective sheet 5 is adhesively fixed to the top surface of second contact plate 27 via adhesive 6 on its bottom surface.

The switch of the present embodiment differs from the switch of the third embodiment in that second contact plate 27 has four arc-shaped slits 27C. Slits 27C are formed at regular intervals on the same circumference around the outer periphery of circular dome-shaped movable part 27B in the center of second contact plate 27. Between four slits 27C, there are provided four joints 27E, which are inclined to entirely raise circular dome-shaped movable part 27B and connected to flat part 27D on the periphery of second contact plate 27.

In other words, circular dome-shaped movable part 27B, which is formed integrally with second contact plate 27 at its center, is made a little higher by four joints 27E than movable part 26B of the third embodiment shown in FIG. 11. This increases the distance between the bottom surface of the top of the dome of movable part 27B and the center of the top surface of first contact plate 21 located beneath it.

In the push-on switch thus structured, the top of the dome of movable part 27B of second contact plate 27 is raised by joints 27E. This increases the operating distance of movable part 27B when protective sheet 5 is pressed from above, then elastically inverted with a click feel, and comes into contact with the top surface of first contact plate 21 located beneath it, thereby turning on the switch. Joints 27E, which support the compressive force applied to movable part 27B while movable part 27B is elastically inverted, slightly bend in the direction to decrease their inclination.

When the user releases the pressing force, movable part 27B elastically returns to the upwardly convex circular dome shape with a click feel with the support of the elastic returning force of joints 27E, so that the bottom surface of movable part 27B moves away from the top surface of first contact plate 21. As a result, the switch is returned to the OFF state.

According to the present embodiment, the operating distance of movable part 27B to be elastically inverted can be increased without using any additional members. As a result, the push-on switch has a long operating distance and high waterproofness.

First contact plates 11 and 21, and second contact plates 12, 22, 25, 26, and 27 in the first to fourth embodiments are silver-plated stainless steel, but may alternatively be made of a silver clad material. In other words, these plates only have to be surface-treated to have excellent conductivity and excellent solderability. The surface treatment is not necessarily applied to both sides; the surface treatment to provide excellent solderability can be applied to the bottom surfaces of first terminals 11A and 21A and second terminals 12A, 22A, 25A, 26A, and 27A, and the surface treatment to provide excellent conductivity can be applied to the contact function part in the center of the switch.

As shown in FIGS. 5 to 13, the tips of first terminals 21A of first contact plate 21, and the tips of second terminals 22A, 25A, 26A, and 27A of second contact plates 22, 25, 26, and 27, respectively, are bent obliquely upward to have a J bent shape. Due to their J bent shape, a self alignment effect acts on each set of four terminals consisting of two first terminals 21A and two second terminals 22A, 25A, 26A, or 27A when molten solder is applied to their bent parts which are to be solder-mounted on a circuit board of an electronic device. As a result, each set of four terminals is positioned in the center of the corresponding lands of the circuit board, thereby stabilizing the mounting position of the push-on switch. The J bent shape can be applied to the terminals of the push-on switch shown in FIG. 1 to provide the same effect. As described hereinbefore, the push-on switch of the present invention can be thin, compact, and high waterproof, thereby being useful mainly to the operating part of various electronic devices.

What is claimed is:

1. A push-on switch comprising:

a first contact plate made of flat conductive sheet metal, the first contact plate having a first terminal at an end thereof;

a second contact plate made of flat conductive sheet metal and facing the first contact plate, the second contact plate having a second terminal at an end thereof, a central opening at a center thereof, and a plurality of positioning holes around the central opening;

a thin-film spacer made of insulating LCP resin and having a center hole, the spacer being disposed between the first contact plate and the second contact plate and integrally bonded thereto;

a movable contact on the second contact plate, the movable contact having a bottom surface facing, at a center thereof, a top surface of the first contact plate with a space therebetween via the central opening of the second contact plate and the center hole of the spacer; and a flexible lid on a top surface of the second contact plate, the lid holding the movable contact, wherein a plurality of positioning parts are formed by softening the spacer with heat and pressure so that the spacer is protruded upward through the positioning holes.

2. The push-on switch of claim 1, wherein the lid is a heat-resistant protective sheet having adhesive on an entire bottom surface thereof.

3. The push-on switch of claim 1, wherein the lid is a heat-resistant protective sheet having a non-adhesive portion and an adhesive portion, the non-adhesive portion corresponding to an area coming into contact with the movable contact, and the adhesive portion corresponding to an area coming into contact with the second contact plate.

4. The push-on switch of claim 1, wherein the second contact plate includes a tongue part extending toward a central portion of the central opening.

5. The push-on switch of claim 1, wherein the first terminal and the second terminal are bent to have a 3 shape.

* * * * *